US008500929B2

(12) United States Patent
Cotton et al.

(10) Patent No.: US 8,500,929 B2
(45) Date of Patent: Aug. 6, 2013

(54) THERMAL PROCESSING METHOD FOR IMPROVED MACHINABILITY OF TITANIUM ALLOYS

(75) Inventors: James D. Cotton, Issaquah, WA (US); William L. Merrick, Des Moines, WA (US); Michael L. Watts, Tacoma, WA (US)

(73) Assignee: The Boeing Company, Chicago, IL (US)

( * ) Notice: Subject to any disclaimer, the term of this patent is extended or adjusted under 35 U.S.C. 154(b) by 725 days.

(21) Appl. No.: 11/536,431

(22) Filed: Sep. 28, 2006

(65) Prior Publication Data

US 2008/0078482 A1 Apr. 3, 2008

(51) Int. Cl.
*C22F 1/18* (2006.01)

(52) U.S. Cl.
USPC ..... 148/670; 148/671

(58) Field of Classification Search
None
See application file for complete search history.

(56) References Cited

U.S. PATENT DOCUMENTS

| | | | | |
|---|---|---|---|---|
| 3,901,743 | A * | 8/1975 | Sprague et al. | 148/669 |
| 4,501,095 | A * | 2/1985 | Drinkuth et al. | 451/5 |
| 2004/0250932 | A1* | 12/2004 | Briggs | 148/670 |
| 2005/0284549 | A1* | 12/2005 | Woodfield et al. | 148/671 |
| 2006/0070688 | A1 | 4/2006 | Fonte et al. | |
| 2010/0180991 | A1* | 7/2010 | Heritier et al. | 148/669 |

FOREIGN PATENT DOCUMENTS

| | | |
|---|---|---|
| JP | 2005320570 | 11/2005 |
| US | EP 1078997 | 2/2001 |

OTHER PUBLICATIONS

Noda et al., "Development of High Performance Heat Resistant Near-Alpha Titanium Alloy Compressor Disk" The Institute of Materials, Titanium '95—Proceedings of the 8th World Conference on Titanium, pp. 2258-2264 (1995).

Donarchie, "Titanium—A Technical Guide," 2.ed, ASM International, ISBN 0-87170-686-5, pp. 192-193 (2000).

Kestler et al., "Optimization of Microstructure and Mechanical Properties of the Hot-Forged Titanium Alloy IMI 834 by Heat Treatment," The Institute of Materials, Titanium '95—Proceedings of the 8th World Conference on Titanium, pp. 1171-1178 (1995).

Kolachev et al., On The Relation Between The Machinability of Titanium Alloys and Their Chemical and Phase Compositions, Tsiolkovskii Russian State University of Technology, Russian Metallurgy (Metally), vol. 2002, No. 3, pp. 284-289.

Yoji Kosaka et al., Influences of Alloy Chemistry and Microstructure on the Machinability of Titanium Alloys, Cost-Affordable Titanium Symposium, TMS (The Minerals, Metals & Materials Society, 2004, pp. 169-176.

Carsten Siemers et al., Deformation and Microstructure of Titanium Chips and Workpiece, Z. Metallkd. 92 (2001) 8, pp. 853-859.

M.A. D'Yakova et al., Changes in the Phase Composition and Properties of the Alloy VT22 After Heat Treatment, Urals Polytechnic Institute, Fiz. Metal. Metalloved., 41, No. 5, 1976, pp. 113-119.

N. A. Moiseeva et al., Isothermal Transformation in a+b Titanium Alloys of Critical Composition, Translated from Metallovedenie i Termicheskaya Obrabotka Metallov, No. 8, pp. 50-52, Aug. 1975.

* cited by examiner

*Primary Examiner* — George Wyszomierski

(57) ABSTRACT

A method is provided for improving the machinability of a titanium alloy includes heating the alloy at a temperature and time period that imparts to the alloy a microstructure having between about 10 and 15 vol. % alpha phase in a beta phase matrix. According to one embodiment, the alloy is thereafter annealed at a temperature lower than the temperature for the initial heating step, and for a duration that is longer than the time period for the initial heating step.

8 Claims, 3 Drawing Sheets

THERMAL PROCESSING METHOD FOR IMPROVED MACHINABILITY OF TITANIUM ALLOYS

TECHNICAL FIELD

The present invention generally relates to alloys that are subjected to machining processes, and more particularly relates to methods for improving the machinability of alloys.

BACKGROUND

Titanium alloys are frequently used in aerospace and aeronautical applications because of their high strength, low density, and corrosion resistance. Although pure titanium has desirable properties for many uses, it is often unsuitable for more demanding structural applications. To achieve the necessary strength and fatigue resistance for use in most aerospace and aeronautical applications, titanium is typically alloyed with other elements. Two prevalent titanium alloys in use in aerospace and aeronautical applications are Ti 64 and Ti 6242. Both of these alloys are titanium-based alloys, meaning that titanium makes up the majority of the alloy in terms of weight percentage. Ti 64 is an alpha-beta alloy that has nominal elemental compositions of about 6 weight percent (wt. %) aluminum and 4 wt. % vanadium, with the balance being titanium. Ti 6242 is also an alpha-beta alloy that has nominal elemental compositions of about 6 wt. % aluminum, 2 wt. % tin, 4 wt. % zirconium, and 2 wt. % molybdenum, with the balance being titanium. Another recently developed titanium alloy that is useful in aerospace and aeronautical applications is Ti 5553 that has nominal elemental compositions of about 5 wt. % aluminum, 5 wt. % vanadium, 5 wt. % molybdenum, 3 wt. % chromium, 0.5 wt. % iron, and 0.15 wt. % oxygen, with the balance being titanium.

Titanium and titanium-based alloys typically exhibit two-phase microstructures. Pure titanium exists as alpha phase having a hexagonal close-packed crystal structure up to its beta transus temperature (about 885° C.). Above the beta transus temperature, the microstructure changes to the beta phase, which has a body-centered-cubic crystal structure. Certain alloying elements may be added to control the microstructure and thereby allow the beta phase to be at least metastable at room temperature. Alpha-beta alloys are typically made by adding one or more beta stabilizers, such as vanadium, which inhibit the transformation from beta phase back to alpha phase and allow the alloy to exist in a two-phase alpha-beta form at room temperature.

Titanium alloys are typically more difficult to machine than many other common aerospace materials such as aluminum-based alloys. Furthermore, some titanium alloys are significantly more difficult than other titanium alloys to machine, with machinability being directly associated with their alloy phase compositions. When examined by alloy phase it is generally understood that despite their higher strength, beta titanium alloys are more difficult to machine than alpha or alpha-beta titanium alloys. This relationship between crystal structure phase and machinability is somewhat problematic for some common titanium alloy processing procedures, which include a beta annealing step immediately after forging the alloy in order to provide increased strength to the part that is formed from the alloy. A particular processing method performed after forging a titanium alloy and before machining the alloy is referred in the art as a "BASCA" process, which includes beta annealing, followed by slow cooling and aging the titanium alloy. Although the BASCA process provides superior strength to many alloys, tests reveal that carbide cutters lose a substantial amount of useful life when machining titanium alloys that are almost entirely beta phase. For example, uncoated carbide cutters used for machining BASCA-treated Ti 5553 alloy have about 25% of their ordinary useful life when compared with Ti6Al4V alloy in a mill-annealed condition having a small beta phase concentration.

There is no conventional process for effectively improving the intrinsic machinability of titanium alloys or other alloys. Some composition-related approaches have typically included adding specific elements to an alloy to change its machining behavior. For example, elements such as sulfur are commonly added to a stainless steel alloy to improve its machinability. However, these chemical treatments typically are performed at the expense of at least some mechanical properties for the treated alloy. Other approaches have included adjusting machining parameters such as cutting tool speeds and characteristics, alloy feed rates, or coolant levels. Although cutting tools and machining processes continue to improve, no tool or process has been universally identified to be exceptionally effective for machining titanium alloys.

Accordingly, it is desirable to improve the machinability of titanium alloys. In addition, it is desirable to provide titanium alloys and parts made therefrom having superior strength without sacrificing machinability. Furthermore, other desirable features and characteristics of the present invention will become apparent from the subsequent detailed description of the invention and the appended claims, taken in conjunction with the accompanying drawings and this background.

BRIEF SUMMARY

A method is provided for improving the machinability of a titanium alloy. First, the alloy is heated at a temperature and time period that imparts to the alloy a microstructure having between about 10 and 15 vol. % alpha phase in a beta phase matrix. According to one embodiment, the alloy is thereafter annealed at a temperature lower than the temperature for the initial heating step, and for a duration that is longer than the time period for the initial heating step.

BRIEF DESCRIPTION OF THE DRAWINGS

Embodiments of the present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Embodiments described herein relate to a metallurgical processing method for titanium alloys that improves their machinability without adding elements to the alloys or otherwise modifying alloy chemistry. The method is tailored to produce a specific microstructure that promotes chip formation during a machining process. Since the alloy rapidly chips due to the stresses produced by a cutting tool, the production rate for parts made from the alloy is increased while extending the useful life of the cutting tool that is being used to machine the alloy.

Figure 1:
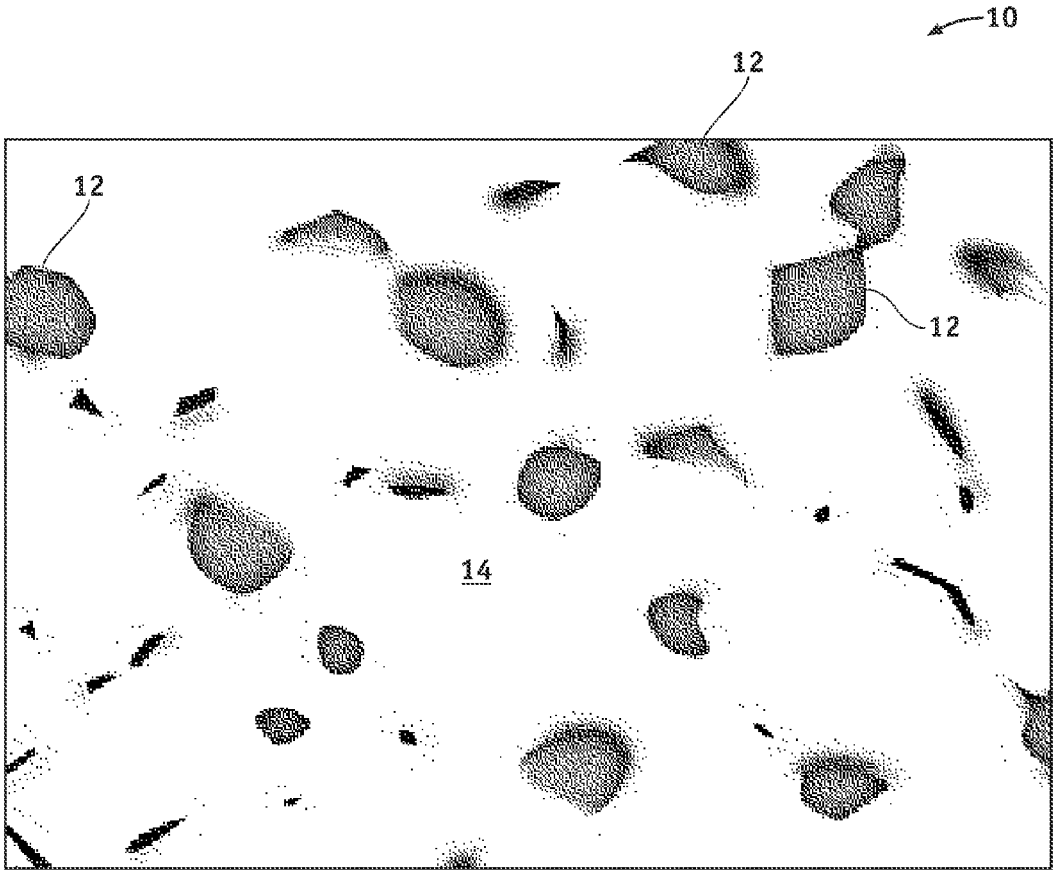
FIG. 1 is a backscattered electron image of a Ti 5553 titanium alloy having alpha phase and beta phase concentrations ranging between 10 and 15 vol. % according to an embodiment of the present invention.

Turning now to FIG. 1, a backscattered electron image (×5,000 magnification) of an exemplary titanium alloy having alpha phase and beta phase concentrations within the range of the present invention is depicted. More particularly, the titanium alloy is a Ti 5553 alloy 10 that is produced using processing methods that will be subsequently discussed, and that has a microstructure that includes approximately 10 vol. % alpha phase 12 within a beta phase matrix 14. As depicted in FIG. 1, the exemplary titanium alloy 10 has a microstructure in which the alpha phase 12 is incorporated as discrete globular particles within the beta phase 14. Titanium alloys according to embodiments of the present invention include between about 10 and about 15% alpha phase, having a substantially hexagonal close-packed crystal structure, with the substantial remainder being a beta phase matrix, having a substantially body-centered-cubic crystal structure. Some minor variations in these crystal structures may be introduced by particular alloy elements without departing from the scope of the invention as long as the crystal structures are substantially intact with appropriate concentrations of alpha and beta phases. The advantage provided by these alpha phase and beta phase concentrations, including those pertaining to alloy machinability, will become apparent in the subsequent discussion. It will be appreciated from the following explanation that although selected titanium alloys are discussed, the processing methods of the present invention may be used to optimize the crystal structure of numerous titanium alloys. Since the processing methods are performed to produce between 10 and 15 vol. % alpha phase, the invention is preferably tailored to beta phase and alpha-beta phase titanium alloys that are capable of retaining their beta or alpha-beta forms at room temperature. Some exemplary titanium alloys are beta and alpha-beta alloys having elements such as aluminum, vanadium, molybdenum, and iron included therein. Other alloying elements such as chromium and oxygen may also be included. Also, notwithstanding the discussion of such titanium alloys, it will be apparent that the processing methods of the present invention may be applied to various non-titanium alloys to optimize their microstructures and thereby improve their machinability.

Figure 2:
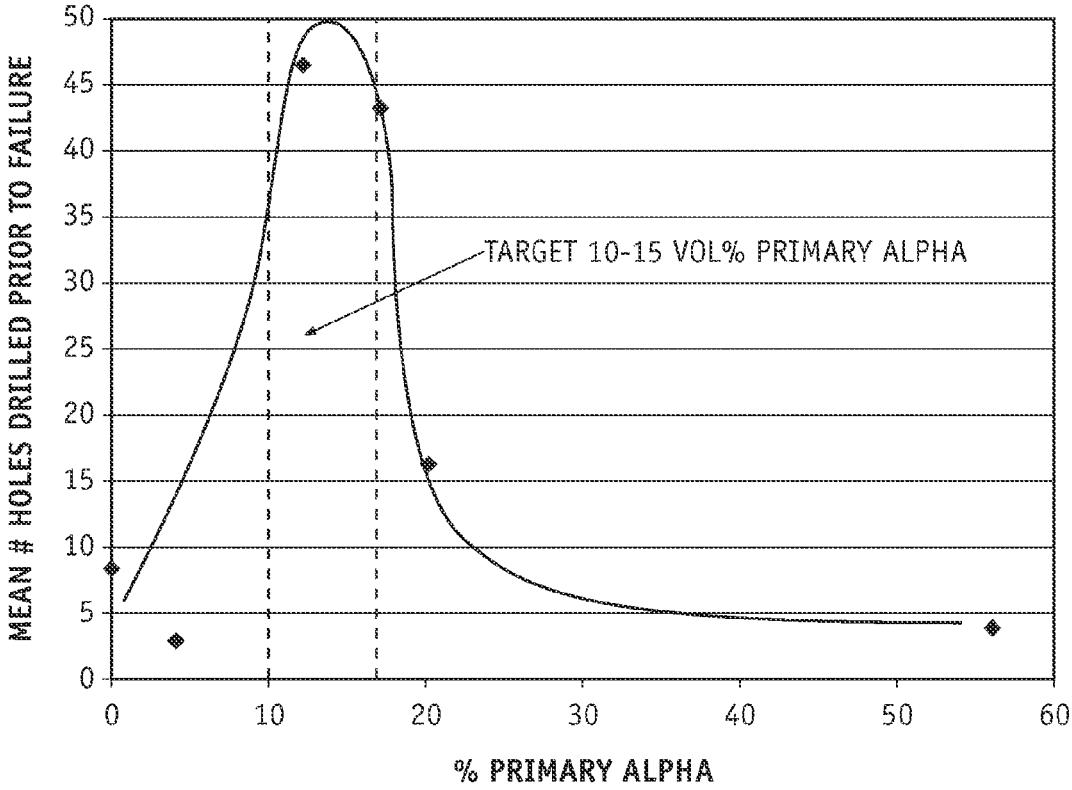
FIG. 2 is a graph illustrating the relationship between the vol. % of alpha phase in a titanium alloy and the alloy's machinability.

The alpha phase content in a titanium alloy has a direct influence on the alloy's machinability. FIG. 2 is a graph representing the relationship between the vol. % of alpha phase in a titanium alloy and the number of holes drilled into the alloy prior to failure of a drill bit. The data shown in FIG. 2 reveal that within the range of about 10 and about 15 vol. % alpha phase, a titanium alloy has significantly better machinability than when the alpha phase concentration is outside of that range. Although the data outlined in FIG. 2 represents tests performed on the particular alloy Ti-5Al-4V-0.6Mo-0.4Fe, the results pertaining to the present invention are consistent with the results from similar tests of other titanium alloys. Surprisingly, even slightly outside of the range of about 10 and about 15 vol. % alpha phase, the alloy's machinability is frequently substantially lower than within that range.

Figure 3A:
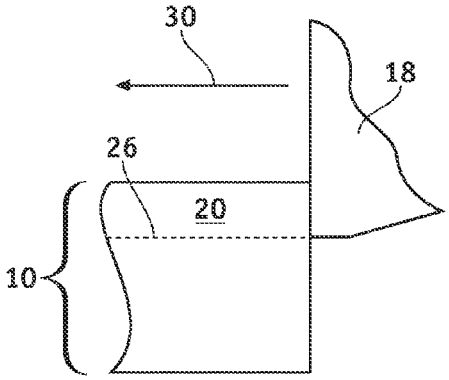
FIGS. 3A to 3D are side views illustrating a machining process for a titanium alloy using a machining tool according to an embodiment of the present invention.
Figure 3B:
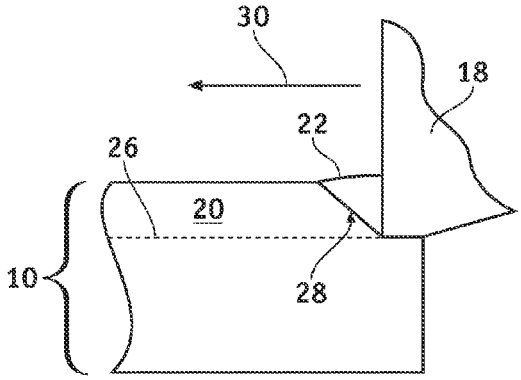
Figure 3C:
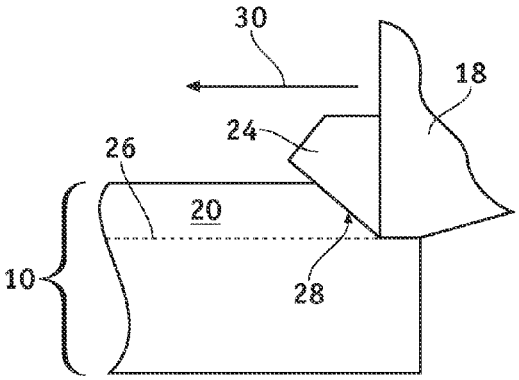
Figure 3D:
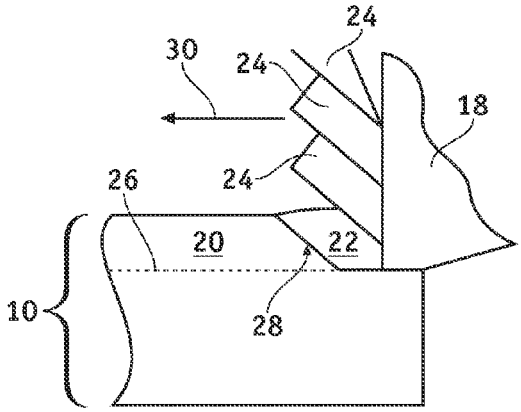

Improved machinability for titanium alloys having between about 10 and about 15 vol. % alpha phase is believed by the inventors to be attributed to the alloy microstructure and its propensity to chip under a shear force. During machining, the titanium alloy readily produces a shear band that promotes chip formation. FIGS. 3A to 3D are illustrations of a machining process for an exemplary titanium alloy 10 using a machining tool 18. Beginning with FIG. 3A, the machining tool 18 is positioned to cut the titanium alloy 10 at a depth designated by discontinuous line 26 and thereby remove alloy portion 20. As the tool 18 progresses in the direction indicated by arrow 30, a force is applied on the alloy 10 that causes nucleation and propagation of a shear band 28 as depicted in FIG. 3B. The force from the tool 18 produces dammed material 22 that breaks from the alloy 10 when it breaks along the shear band 28 to produce a chipped segment 24 as depicted in FIG. 3C. Continued force produced by the tool 18 causes continued nucleation and propagation of additional shear bands 28, which in turn produces numerous rough chipped segments 24 as depicted in FIG. 3D. Since the shear bands 28 are readily propagated, the chipped segments and the underlying alloy 10 experience little to no deformation. Shear band development in the alloy 10 is believed to be promoted by the discrete globular alpha phase portions, which theoretically break to produce fractures in the alloy that then connect with each other to form the shear bands 28.

Figure 5:
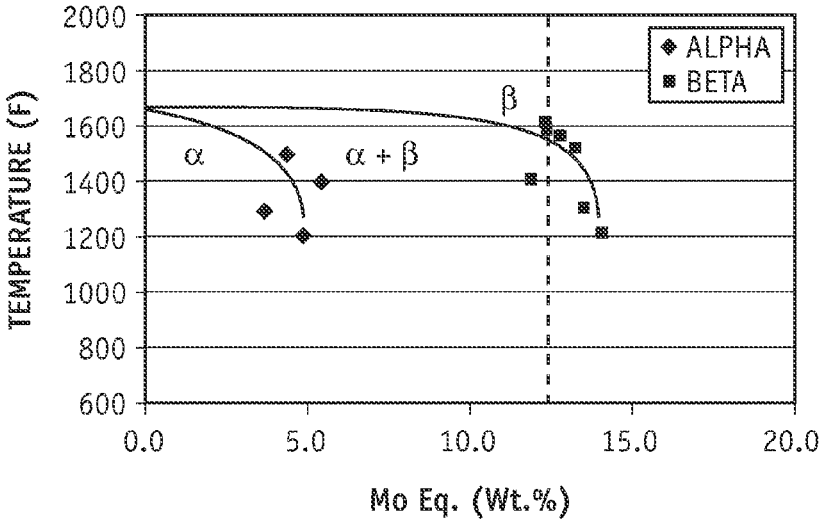
FIG. 5 is a pseudobinary phase diagram for a T 5553 alloy and is used to determine an optimal heating cycle for modifying the alloy crystal phase and thereby improve its machinability according to an embodiment of the invention.
Figure 4:
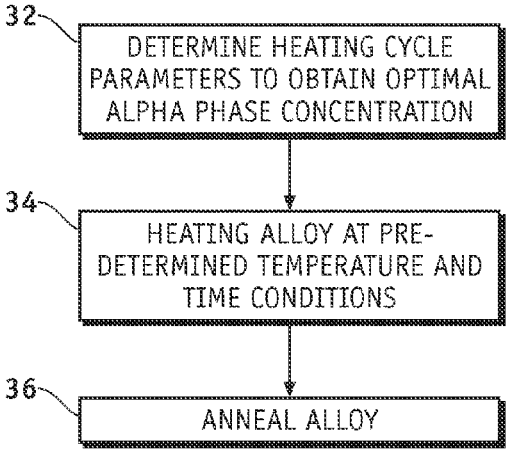
FIG. 4 is a flow chart outlining an alloy processing method according to an embodiment of the present invention.

Turning now to FIG. 4, a flow chart illustrates an exemplary method for optimizing an alloy's crystal structure and consequently imparting improved machinability to the alloy. First, the alloy characteristics are considered in order to determine a set of heating cycle parameters for improving the alloy machinability as step 32. One way that an adequate heating cycle may be determined is by producing or obtaining a pseudobinary phase diagram for the desired alloy that exhibits the volume fraction of alpha phase in the alloy as a function of annealing temperature. For example, FIG. 5 is an original pseudobinary phase diagram for a Ti 5553 alloy and illustrates how an optimal heating cycle is determined for modifying the alloy crystal phase to thereby improve its machinability according to an embodiment of the invention. For many alloys, a pseudobinary phase diagram is published and readily available. For other alloys, a diagram may need to be created from newly created data. By reviewing the diagram for a particular alloy and applying lever law calculations, a heating temperature range can be determined at which between 10 and 15 vol. % of the alloy will be alpha phase. For the T 5553 alloy, a lever law calculation using data representing the diagram of FIG. 5 reveals that 10 to 15 vol. % alpha phase will be obtained by heating the alloy to between about 700 and 815° C. (between about 1300 and 1500° F.).

A heating period should be determined along with the optimal temperature range for alpha phase conversion. An exemplary heating cycle is performed for a period of two to four hours, and within that range the necessary heating cycle period to perform a prescribed alpha phase conversion generally shortens as the temperature increases. Lower temperatures and longer heating cycle periods may be selected depending on the alloy being treated and its particular microstructure and thermal properties.

Upon establishing the heating cycle parameters for a particular alloy, the alloy is heated at the predetermined temperature and time period as step 34. This heating cycle will bring the alloy to between 10 and 15 vol. % alpha phase. According to an exemplary method, the heating cycle is followed by a second, lower-temperature long-time annealing cycle as step 34. The annealing step produces several potential qualitative features to the alloy that may not be produced from the previous heating cycle. First, the annealing step precipitates as much alpha phase as possible and thereby removes alpha-stabilizing elements such as aluminum from the beta solution, which in turn improves the thermal conductivity of the beta phase in the alloy. Furthermore, the annealing step increases the volume concentration of alpha phase within the prescribed range. Raising the alpha phase volume fraction increases the modulus of a titanium alloy, which will reduce machining chatter during subsequent alloy machining. The annealing step also coarsens alpha phase precipitates and thereby produces overaging and reduces their strength within the stronger beta phase alloy concentration. As previously discussed, the strength reduction improves the alloy machinability.

The long time annealing process is performed at a temperature that is lower than the previous thermal cycle temperature. An exemplary anneal is performed at a temperature that approaches the lowest temperature at which overaging is possible for the alloy being treated. However, a preferred annealing temperature is also sufficiently high to prevent re-solutionizing significant amounts of alpha phase. According to an exemplary embodiment, the annealing process is performed for a period ranging between four and twenty-four hours. The temperature and time period for the annealing process may be further tailored based on known aging behaviors for a particular alloy. Continuing with the example regarding the Ti 5553 alloy, a review of literature for similar alloys suggests that a temperature of about 650° C. (about 1200° F.) is suitable to properly anneal and age the alloy following the initial heating cycle.

As previously discussed, one conventional processing method that is performed after forging a titanium alloy and before machining the alloy is referred in the art as a "BASCA" process, which includes beta annealing, followed by slow cooling and aging the titanium alloy. Although the BASCA process provides superior strength to many alloys, tests reveal that carbide cutters lose a substantial amount of useful life when machining titanium alloys that are almost entirely beta phase. According to an exemplary method, the initial heating cycle of step 32, and if necessary, the lower-temperature long-time annealing cycle of step 34, are performed before machining an alloy. After thereby optimizing the alloy content to between 10 and 15 vol. % alpha phase, the alloy is machined at least to its rough working configuration. Thereafter, the alloy may be further treated according to a BASCA process to increase the beta phase to greater than 90 vol. %, and in some cases to nearly 100 vol. %. Following the BASCA process, additional fine machining may be performed on the alloy as necessary. Since at least the major machining is completed with the alloy content between 10 and 15 vol. % alpha phase prior to performing the BASCA process, the overall machining is completed in a significantly shorter time than when the alloy is between 90 and 100% beta phase. Further, the useful life of machining tools is extended since the alloy is more easily machined and tool wear is reduced.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for processing a titanium alloy, comprising:

heating the alloy at a temperature and time period that impart to the alloy a microstructure having between about 10 and 15 vol. % alpha phase in a beta phase matrix;

machining the alloy after the heating; and annealing, cooling, and aging the alloy after the machining to impart to the alloy a microstructure having a beta phase content that is greater than 90 vol. %.

2. The method according to claim 1, wherein the heating is performed for a period ranging between about two and four hours.

3. The method according to claim 1, wherein the step of annealing, cooling and aging impart to the alloy a microstructure having a beta phase content that is nearly 100 vol. %.

4. The method according to claim 1, wherein the alpha phase is present as globular particles within the beta phase matrix prior to machining.

5. A method comprising starting with a titanium alloy selected for improved machinability, the titanium alloy having been heated and then slowly annealed at a temperature lower than the heating temperature to impart a microstructure having between about 10 and 15 vol. % globular alpha phase in a beta phase matrix; machining the alloy having the globular alpha phase in a beta phase matrix; and annealing, cooling, and aging the alloy after the machining to increase beta phase content above 90 vol. %.

6. The method according to claim 5, wherein the heating step is performed for a period ranging between about two and four hours.

7. The method according to claim 5, wherein the annealing, cooling and aging increases the beta phase content to nearly 100 vol. %.

8. The method according to claim 5, wherein the alloy had been slowly annealed for a duration between 12 and 24 hours prior to machining.

* * * * *